US006341461B1

(12) United States Patent
Crowley et al.

(10) Patent No.: US 6,341,461 B1
(45) Date of Patent: Jan. 29, 2002

(54) MODULAR WALL PANEL SYSTEM

(75) Inventors: John S. Crowley, Portland; Edward H. Lameyer; John MacDiarmid, both of Yarmouth, all of ME (US)

(73) Assignee: New England Classic Interiors, Inc., South Portland, ME (US)

( * ) Notice: Subject to any disclaimer, the term of this patent is extended or adjusted under 35 U.S.C. 154(b) by 0 days.

(21) Appl. No.: 09/640,980

(22) Filed: Aug. 17, 2000

Related U.S. Application Data

(63) Continuation of application No. 08/781,056, filed on Jan. 9, 1997, now abandoned.

(51) Int. Cl.[7] ..... E04B 2/00; E04F 13/10

(52) U.S. Cl. ..... 52/311.2; 52/519; 52/536; 52/554; 52/506.01; 52/592.1

(58) Field of Search ..... 52/506.01, 506.05, 52/311.1, 311.2, 592.1, 519, 536, 554, 506.06

(56) References Cited

U.S. PATENT DOCUMENTS

| | | | | |
|---|---|---|---|---|
| 741,524 A | | 10/1903 | Miller | |
| 2,594,928 A | | 4/1952 | Horowitz | 20/4 |
| 3,981,112 A | | 9/1976 | Dake | 52/184 |
| 4,557,096 A | | 12/1985 | Hovde | 52/595 |
| 4,724,638 A | | 2/1988 | Bezborodko | 52/311 |
| 4,736,559 A | | 4/1988 | Young | 52/313 |
| 5,056,283 A | | 10/1991 | Sapinski | 52/184 |
| 5,526,857 A | * | 6/1996 | Forman | 144/346 |
| 5,884,444 A | | 3/1999 | Harris | 52/311.2 |
| 5,894,701 A | | 4/1999 | Delorme | 52/801.11 |

FOREIGN PATENT DOCUMENTS

| | | | | |
|---|---|---|---|---|
| CH | 134020 | * | 11/1929 | 52/506.01 |

OTHER PUBLICATIONS

Stair–Pak, Panel–Pak Wainscoting, Stair–Pak Products Co., Inc., Sold Since 1989, 4 pages.
Contract Joinery, Ken Austin, pp. 79–84, First U.S. Publication Aug. 1988.
Cabinet Factory, "Where Custom Made Quality Begins," Cabinet Factory, Inc., 1983, 4 pages.
The Hyde Park Raised Panel System, The Return of Elegance at an Affordable Price, Hyde Park Lumber Company, 1989 5 pages.
Mid–America Building Products, A Tapco International Company. The Mid–America Master Series, 1997, 4 pages.
How To Install Plywood Wall Paneling, Georgia–Pacific Corporation, 1993, 2 pages.
How To Install Panelboard Wall Paneling, Georgia–Pacific Corporation, 1993 2 pages.
SelecTrim Panelling System, The James Wood Company, Feb. 24, 1993, 3 pages.
"The Cost of Solid Wood Raised Panels Is Ridiculous!!!", American Panels, May/Jun. 1993, 2 pages.
Miscellaneous Millworks, Woodharbor, 1996, pp. MM1–MM4.
Estate Winscotting Library Systems, Mantelcraft, Inc., Mar. 1995, 4 pages.

(List continued on next page.)

*Primary Examiner*—Robert Canfield
(74) *Attorney, Agent, or Firm*—Heslin Rothenberg Farley & Mesiti P.C.

(57) ABSTRACT

A wood panel system that includes an upper rail, a lower rail and a stile is provided. The upper rail and lower rails are in rigid communication with a wall, while the stile may float between the upper and lower rails. In certain embodiments, the upper rail and the stile are joined by a noncoped groove. The outer edges of the upper rail and the stile may be disposed within different planes that are each parallel to the wall. The upper rail may have a lip that extends over a portion of the stile. Preferably, the stile is formed of a wood veneer coated core material.

27 Claims, 10 Drawing Sheets

OTHER PUBLICATIONS

New England Classic Raised Panel System, New England Classic Interiors, 1996, Booklet and Installation Guide, pp. 1–15.

New England Classic Raised Panel System, Brochure describing features, benefits, installation, parts, etc. (1997).

Crowley, pending U.S. Patent application No. 09/605,251, filed Jun. 28, 2000, entitled Adjustable Sizeable Raised Panel System For Stairs And Methods For Forming And Installing Same (Attorney Docket No. 1801.001).

* cited by examiner

MODULAR WALL PANEL SYSTEM

RELATED APPLICATION

This application is a continuation of U.S. Ser. No. 08/781,056, filed Jan. 9, 1997 now abandoned.

BACKGROUND

1. Field of the Invention

The present invention relates generally to modular wall panels systems, and more specifically to such systems having reduced complexity and cost.

2. Discussion of the Related Art

Modular wall panel systems have been known for decades. FIG. 1 depicts one such related art system 10 that includes an upper rail 12, a lower rail 14, stiles 16, panels 18 with raised portions 20, a cap 22 and a base shoe 24. Conventionally, panels 18 are made of a solid wood, rather than a wood veneer coated core material, so panels 18 comparatively are expensive to fabricate. Moreover, since panels 18 may be relatively wide (e.g., greater than six inches), panels 18 are made of several pieces of solid wood that are glued together, resulting in visible seams 19 that reduce the aesthetic value of system 10.

FIG. 2 shows that a stile 16 is joined to upper rail 12 and lower rail 14 by use of an intricately machined joint 26, commonly referred to as a coped joint, with tight tolerances. Preparing such coped joints is typically a complex job that is performed by a highly skilled artisan with the use of specialized equipment, increasing the cost of preparing system 10. Moreover, due to these coped joints, stiles 16 are stapled, nailed or otherwise in rigid communication with the wall. Any holes formed in stiles 16 during this process are filled with wood putty and subsequently painted or stained, reducing the aesthetic value of system 10.

In system 10, the outer surfaces 17, 13 and 15 of stile 16, upper rail 12 an lower rail 14, respectively, are located in substantially the same plane for aesthetic reasons. If the outer surface of any of these components is even slightly out of plane, the appearance of system 10 is greatly diminished. Therefore, the outer surfaces of these components are often precision sanded subsequent to assembly of system 10. Since this type of sanding can remove wood veneer coatings to expose the core material, stile 16, upper rail 12 and lower rail 14 normally are formed from solid wood, increasing the cost of system 10.

FIGS. 3A and 3B show different embodiments of the manner in which stile 16 is joined to panel 18. In the embodiment shown in FIG. 3A, stile 16 and panel 18 are flush with the wall, and stile 16 has a lip 28 under which a tongue portion 30 of panel 18 fits. In the embodiment shown in FIG. 3B, stile 16 is flush with the wall, but panel 18 is displaced a distance from the wall. Stile 16 has an outer lip 32 and an inner lip 33 between which a tongue portion 34 of panel 18 fits. In both of these embodiments, stile 16 and panel 18 should remain flush as the wood expands and contracts with changes in temperature and humidity for system 10 to maintain its aesthetic appeal. Therefore, while stiles 16 are in rigid communication with the wall, panels 18 are allowed to float between stiles 16, upper rail 12 and lower rail 14 without being in rigid communication with the wall.

FIG. 4 shows the manner in which stiles 16*a* and 16*b* of system 10 are joined at an outside corner of a wall. Stiles 16*a* and 16*b* have edges 36*a* and 36*b*, respectively, that are mitered to 45° angles so that the stiles can be joined effectively with a good seal. Because stiles 16*a* and 16*b* typically are formed of relatively long pieces of wood (e.g., twenty-four to thirty inches), forming these mitered 45° angles can be difficult and time consuming.

In view of the foregoing discussions, it can be seen that, despite the limitations on the aesthetic value of traditional wall panel systems, these systems can be relatively expensive, complicated and time consuming. Usually, a highly skilled artisan prepares these wall panel systems. Therefore, it is desirable within the art to provide an aesthetically appealing wall panel system that is comparatively inexpensive to prepare and simple to install. In particular, it would be advantageous to provide such a system that could be installed by non-highly skilled artisans in a relatively short period of time.

SUMMARY OF THE INVENTION

In one illustrative embodiment, the present invention provides a wood panel system. The system comprises an upper rail, a lower rail and a stile. The upper rail has a noncoped groove and is in rigid communication with a wall. The lower rail has a groove and is in rigid communication with the wall. The stile has an upper tongue and a lower tongue. The upper tongue is adjacent to the noncoped groove of the upper rail, and the lower tongue is adjacent the groove of the lower rail.

In another illustrative embodiment, the present invention provides a wood panel system. The system comprises an upper rail, a lower rail and a stile. The upper rail also has a groove and is in rigid communication with the wall. The lower rail has a groove and is in rigid communication with the wall. The stile has an upper tongue, a lower tongue and an outer edge. The upper tongue is adjacent to the groove of the upper rail, and the lower tongue is adjacent the groove of the lower rail. The upper rail has an outer edge that is located in one plane substantially parallel to the wall, and the stile has an outer edge that is located in a different plane substantially parallel to the wall.

In yet another illustrative embodiment, the present invention provides a wood panel system. The system comprises an upper rail, a lower rail and a stile. The upper rail has a lip that extends over a portion of the stile. The upper rail also has a groove and is in rigid communication with a wall. The lower rail has a groove and is in rigid communication with the wall. The upper tongue is adjacent the groove of the upper rail, and the lower tongue is adjacent the groove of the lower rail.

In a further illustrative embodiment, the present invention provides a wood panel system. The system comprises an upper rail, a lower rail and a stile. The upper rail has a groove and is in rigid communication with a wall. The lower rail has a groove and is in rigid communication with the wall. The stile has an upper tongue and a lower tongue. The upper tongue is adjacent the groove of the upper rail, and the lower tongue is adjacent the groove of the lower rail. The stile floats with respect to the upper and lower rails.

In still a further illustrative embodiment, the present invention provides a wood panel system. The system comprises an upper rail, a lower rail and a stile. The upper rail has a groove and is in rigid communication with a wall. The lower rail has a groove and is in rigid communication with the wall. The stile has an upper tongue and a lower tongue. The upper tongue is adjacent the groove of the upper rail, and the lower tongue is adjacent the groove of the lower rail. The stile is formed of a core material surrounded by a wood veneer.

DETAILED DESCRIPTION

Figure 1:
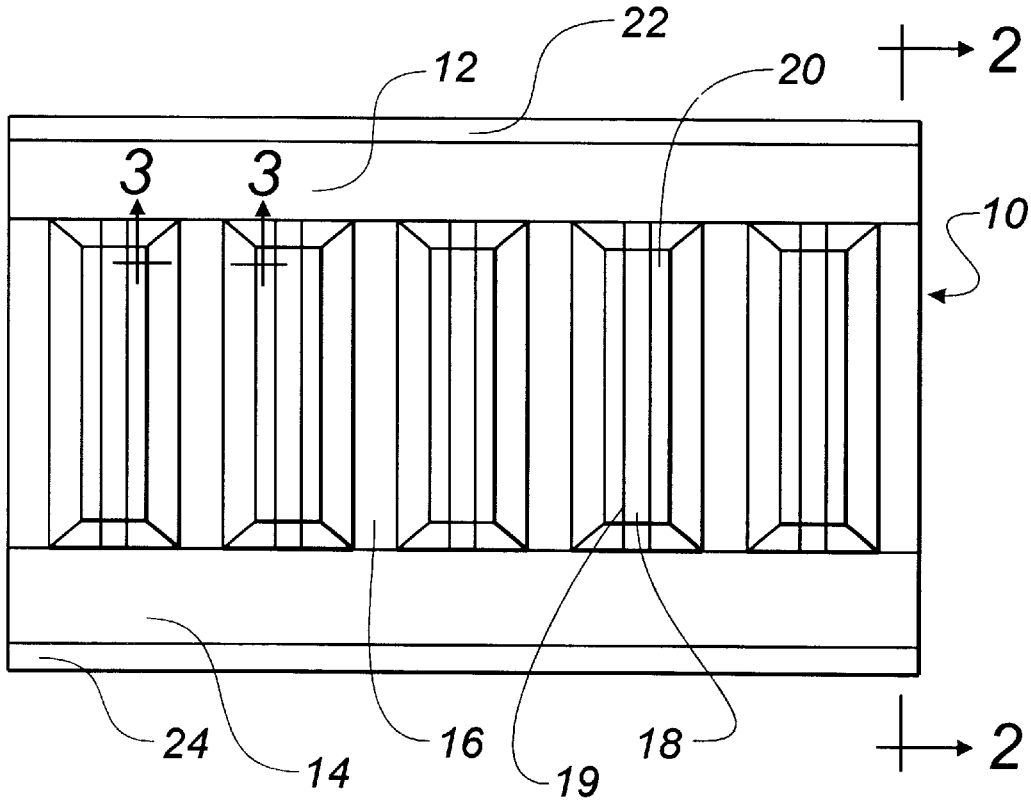
FIG. 1 (Related Art)
FIG. 1 is an elevational view of a wall panel system according to the related art.
Figure 2:
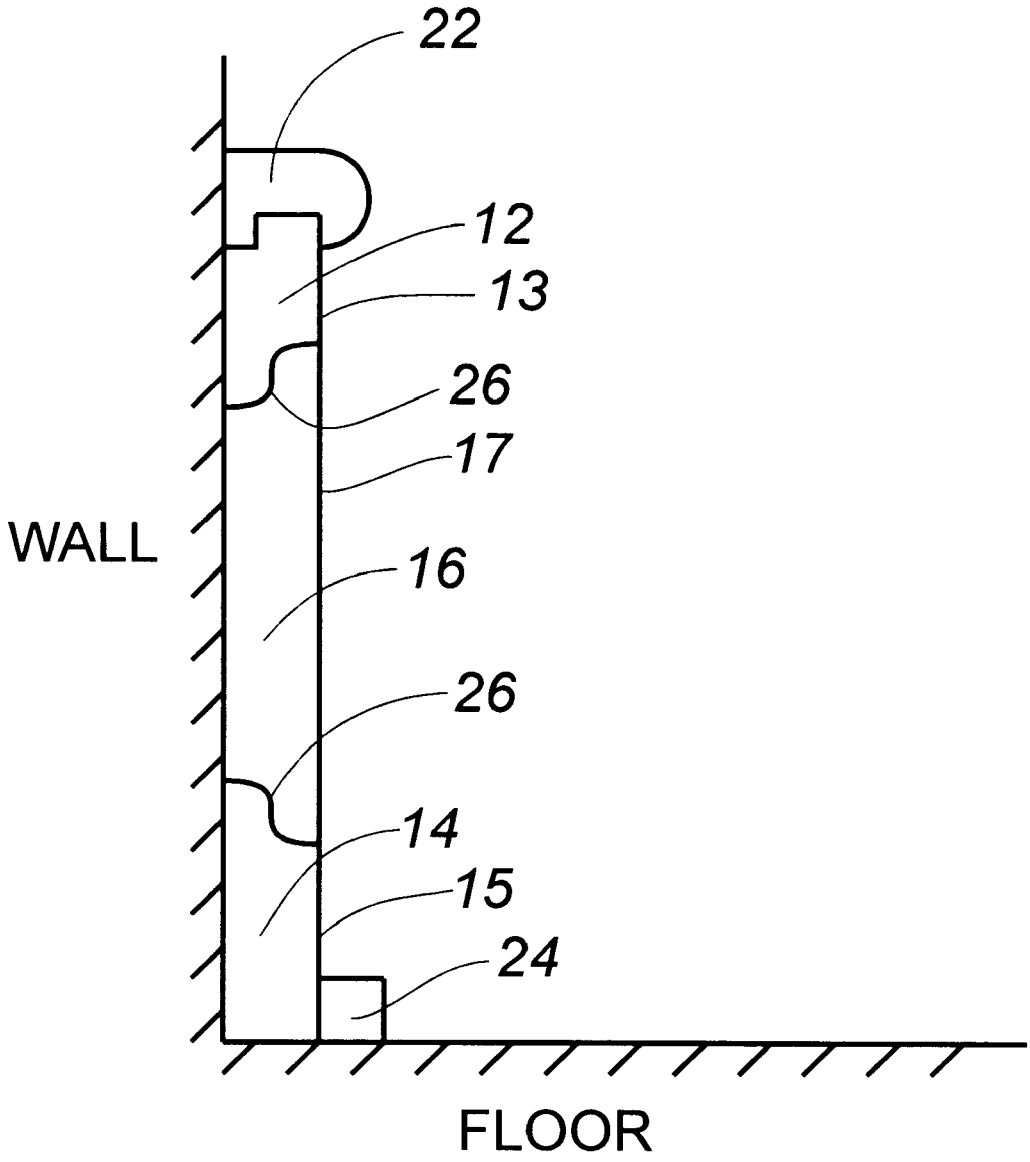
FIG. 2 (Related Art)
FIG. 2 is a cross-sectional view of the related art wall panel system of FIG. 1 taken along line 2—2.
Figure 3A:
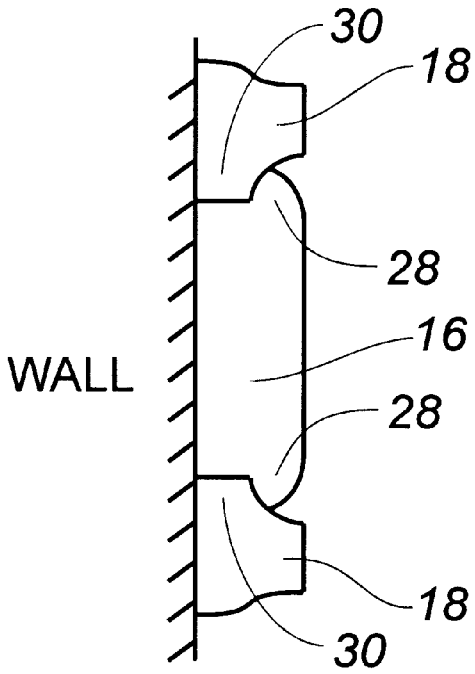
FIG. 3A (Related Art)
FIGS. 3A and 3B are cross-sectional views of two embodiments of the related art wall panel system of FIG. 1 taken along line 3—3.
Figure 3B:
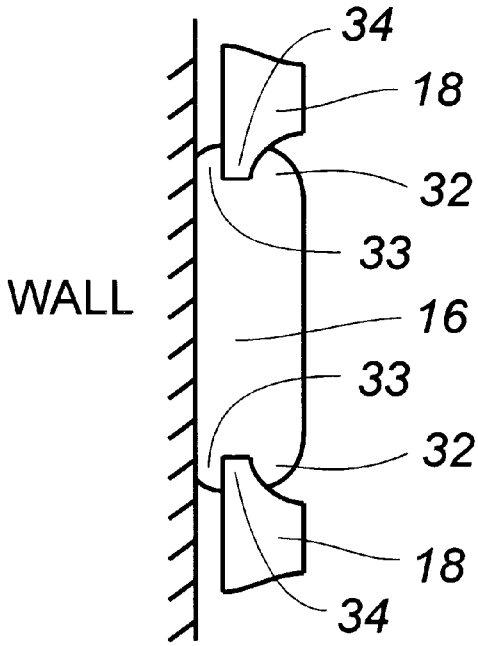
FIG. 3B (Related Art)
Figure 4:
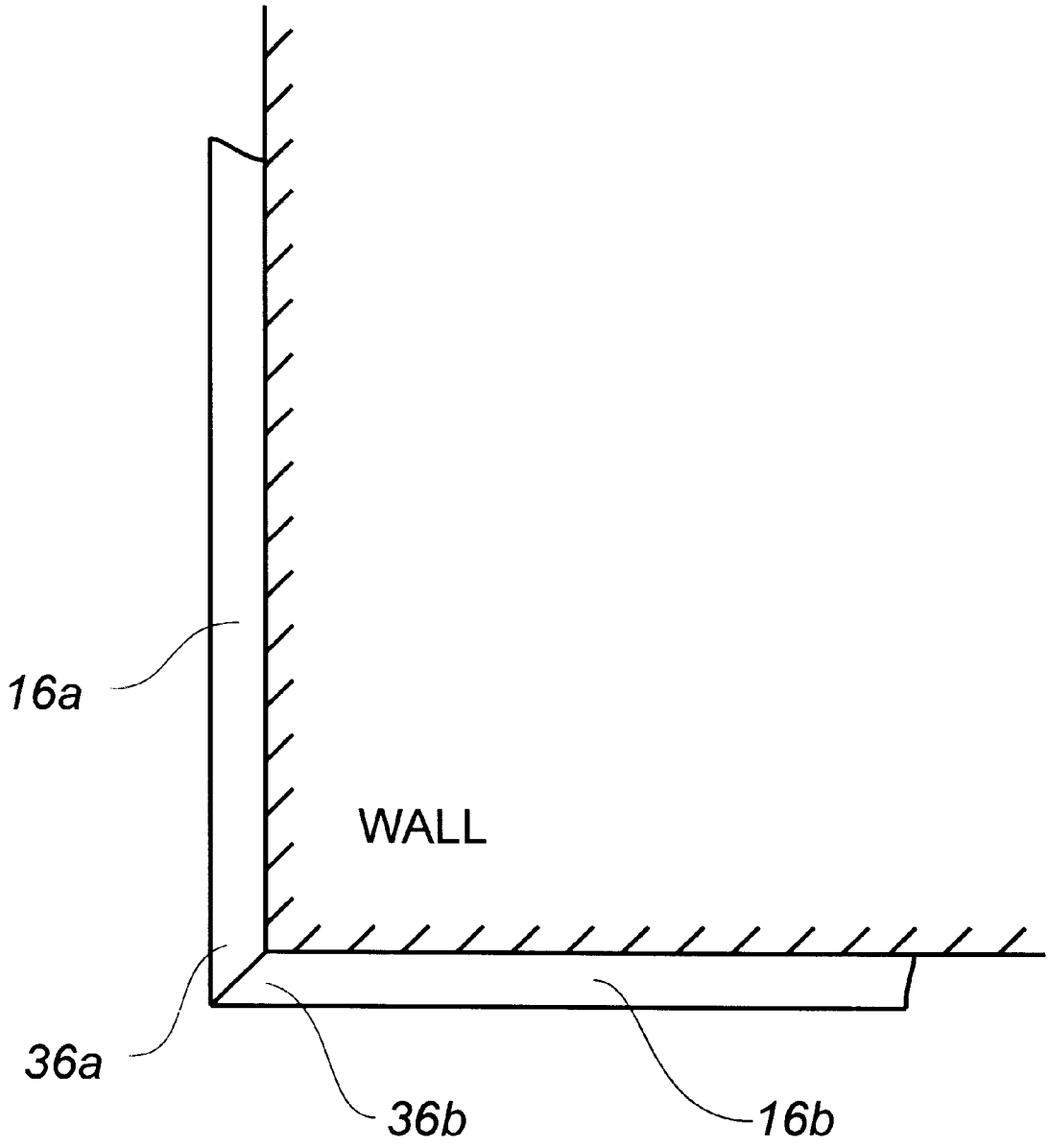
FIG. 4 (Related Art)
FIG. 4 is a cross-sectional view through the stiles of a wall panel system at an outside corner according to the related art.
Figure 5:
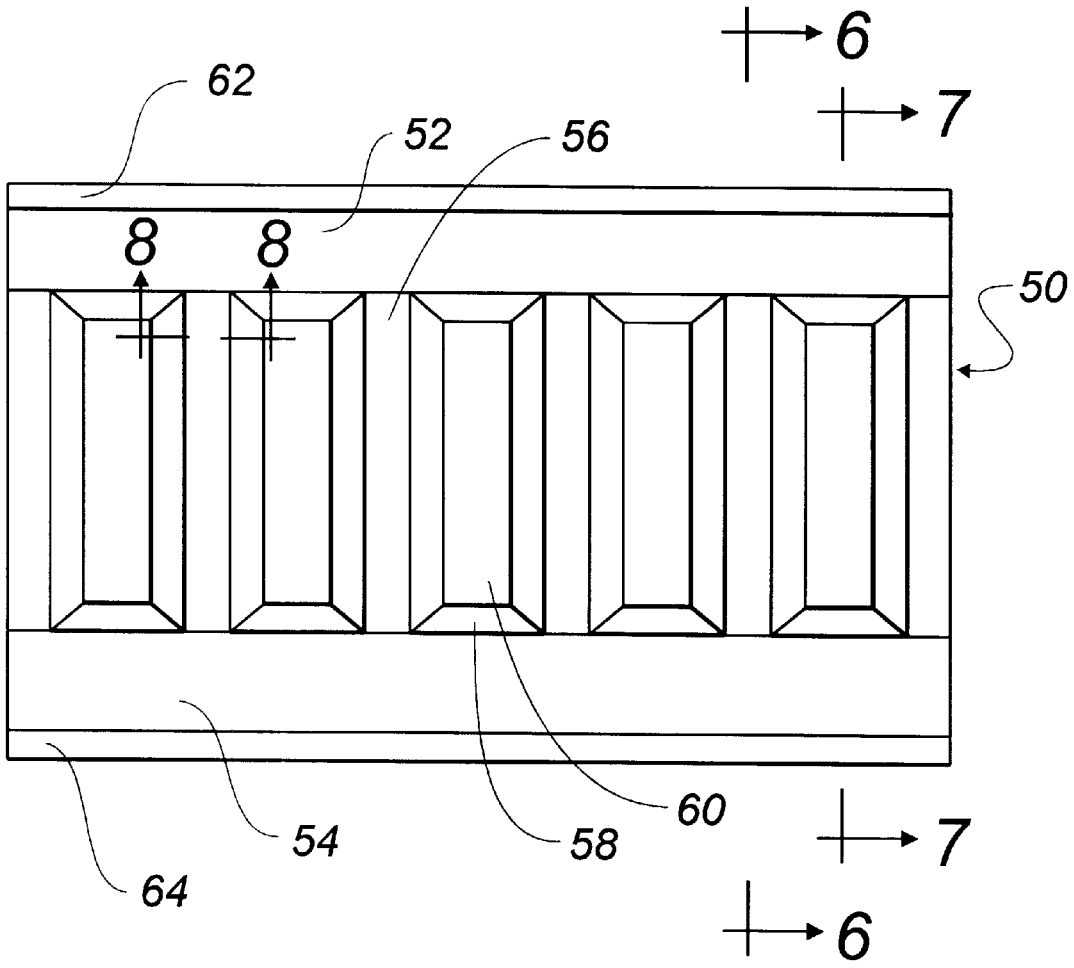
FIG. 5 is an elevational view of a wall panel system according to one embodiment of the present invention.
Figure 6:
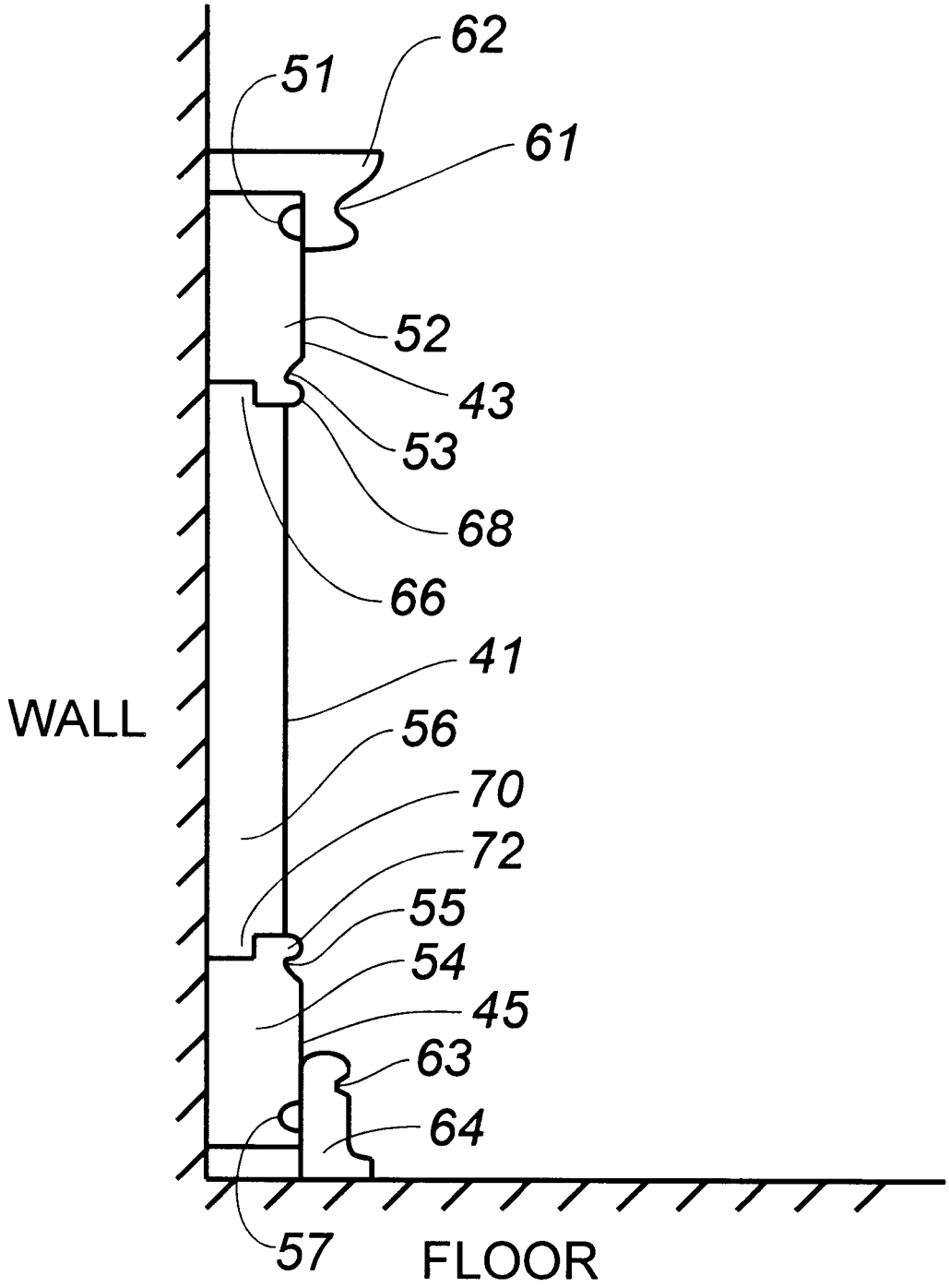
FIG. 6 is a cross-sectional view of the wall panel system of FIG. 5 taken along line 6—6.

In one aspect, the present invention relates to a modular wall panel system 50 as shown in FIG. 5. System 50 includes an upper rail 52, a lower rail 54, stiles 56, panels 58 with raised portions 60, a cap 62 and a base shoe 64. Stile 56 has an upper tongue portion 66 that fits between a lip 68 in upper rail 52 and the wall (FIG. 6). Stile 56 also has a lower tongue portion 70 that fits between a lip 72 in lower rail 54 and the wall. In contrast to traditional wall panel systems, the outer surface 41 of stile 56 is in a different plane from outer surface 43 of upper rail 52 and outer surface 45 of lower rail 54. Outer surfaces 43 and 45, however, should be in substantially the same place. This arrangement creates a strong shadow between outer edges 41, 43 and 45 which differentiates and distinguishes these surfaces, making the effect clearly intentional. As a result, the aesthetic value of system 50 is not diminished.

An additional benefit from this arrangement of outer surfaces 41, 43 and 45 arises due to the fact that these surfaces need not be sanded subsequently to assembly. Thus, stile 56, upper rail 52 and/or lower rail 54 may be formed of a wood veneer coated core material. To maintain the aesthetic appeal of system 50, however, each of these components should be made of the same wood veneer coated core material.

Preferably, the core material is less expensive than is the wood from which the veneer coating is made. In addition, to reduce the expansion and contraction of these components of system 50, the coefficient of thermal and/or humidity expansion of the core material should be less than that for the wood material from which the veneer coating is made. An illustrative and nonlimiting list of appropriate core materials includes medium density fiber board, particle board and wheat board.

The wood veneer coating may be applied using standard techniques, such as profile wrapping or vacuum forming. This coating should be thick enough to provide an aesthetically appealing wood appearance to system 50. If the wood veneer coating is too thick, however, the components of system 50 may undergo so much expansion or contraction with temperature and humidity changes that the aesthetic value of system 50 may be compromised. Therefore, the wood veneer coating preferably has a thickness of at most about 0.17 inches, more preferably less than about 0.05 inches and most preferably from about 0.015 inches to about 0.025 inches.

Figure 7:
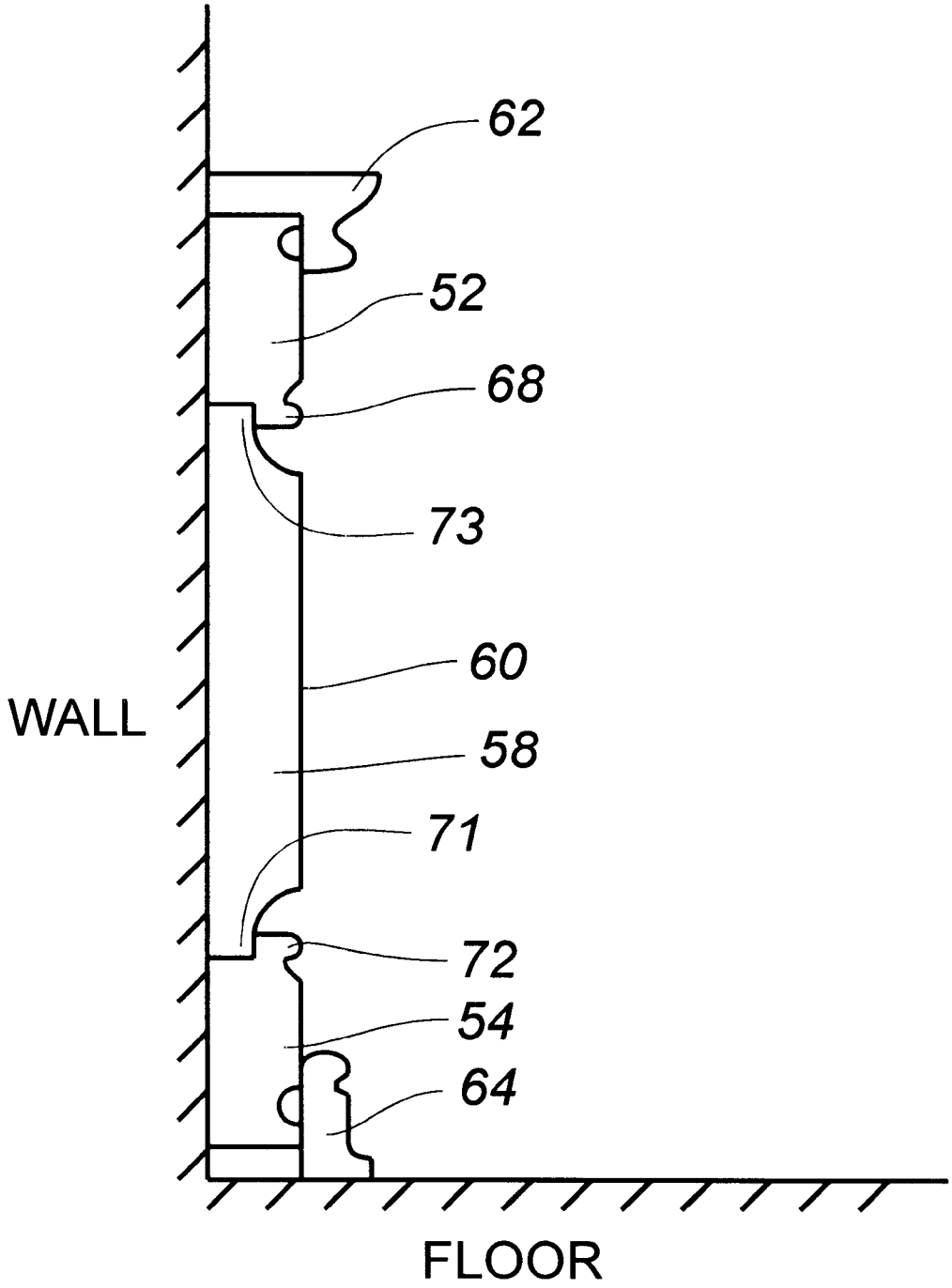
FIG. 7 is a cross-sectional view of the wall panel system of FIG. 5 taken along line 7—7.
Figure 8:
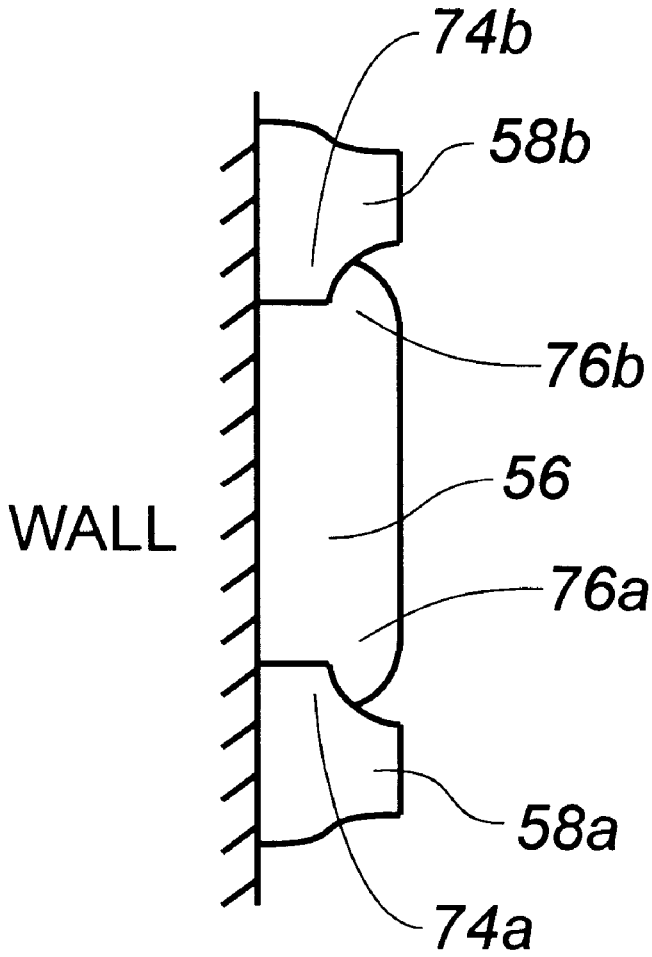
FIG. 8 is a cross-sectional view of the wall panel system of FIG. 5 taken along line 8—8.

During assembly of system 50, lower rail 54 may be attached to the wall surface by the use of nails or staples disposed within groove 55 and/or groove 57. Other similar devices for attaching rail 54 to the wall surface may also be used. Next, tongue portion 70 of stile 56 is placed between lip 72 of lower rail 54 and the wall. Similarly, tongue portion 71 of panel 58 is placed between lip 72 and the wall (FIG. 7). Stile 56 then is joined with adjacent panels 58*a* and 58*b* by fitting tongue portions 74*a* and 74*b* between lips 76*a* and 76*b*, respectively, and the wall (FIG. 8). Lip 68 of upper rail 52 is placed above tongue portion 66 of stile 16 and tongue portion 73 of panel 58. Upper rail 52 is subsequently attached to the wall surface by placing nails, staples or other similar devices within groove 51 and/or 53. Cap 62 is attached to upper rail 52 using adhesives disposed along the back portion of cap 62. Alternatively, nails, staples or equivalent devices placed within groove 61 to attach cap 62 to rail 52. Base shoe 64 is similarly attached to the wall and lower rail 52 by placing nails, staples or equivalent devices within groove 63.

With this arrangement of system 50, coping is not required at the joints between stile 56 and rails 52 and 54 (i.e., stile 56 is joined to rails 52 and 54 using noncoped grooves which have simple designs, including straight edges, that do not require the use of a highly skilled artisan to machine or assemble), so a person without advanced skills in wood working can readily prepare and/or assemble these elements of system 50. Moreover, the absence of coped joints allows stiles 56 to float between rails 52 and 54 without being stapled, nailed or otherwise rigidly attached to the wall. Hence, unlike traditional wall panel systems, both stiles 56 and panels 58 can be moved laterally under lip 72 of lower rail 52 during assembly, making system 50 easier to put together than traditional wall panel systems. Furthermore, in contrast to traditional wood panel systems, the aesthetic value of system 50 is not compromised by filling portions of stiles 56 with wood putty and subsequently painting or staining these portions.

To reduce the expansion and contraction of panels 58, cap 62 and base shoe 64 due to changes in humidity and temperature, these components should be made of a wood veneer coated core material. Preferably, panels 58, cap 62 and base shoe 64 are made of the same wood veneer coated core material as are stiles 56, upper rail 52 and lower rail 54.

If system 50 is to be assembled to a wall having a substantial bow or cup, a small amount of construction adhesive may be applied to the back of stiles 56 and/or panels 58 using a caulking gun or other appropriate device. The adhesive can work as a formable spacer which reduces the effect of the bow or cup. This allows stiles 56 and/or panels 58 to be held away from the wall and against rails 52 and 54.

Similar to conventional wood panel systems, the ends of upper rail 52, lower rail 54, cap 62 and base shoe 64 all are mitered at a 45° angle at an outside corner of a wall. However, in contrast to traditional wood panel systems, the ends of stiles 56 that intersect at an outside corner need not be mitered, reducing the complexity of assembling system

Figure 9:
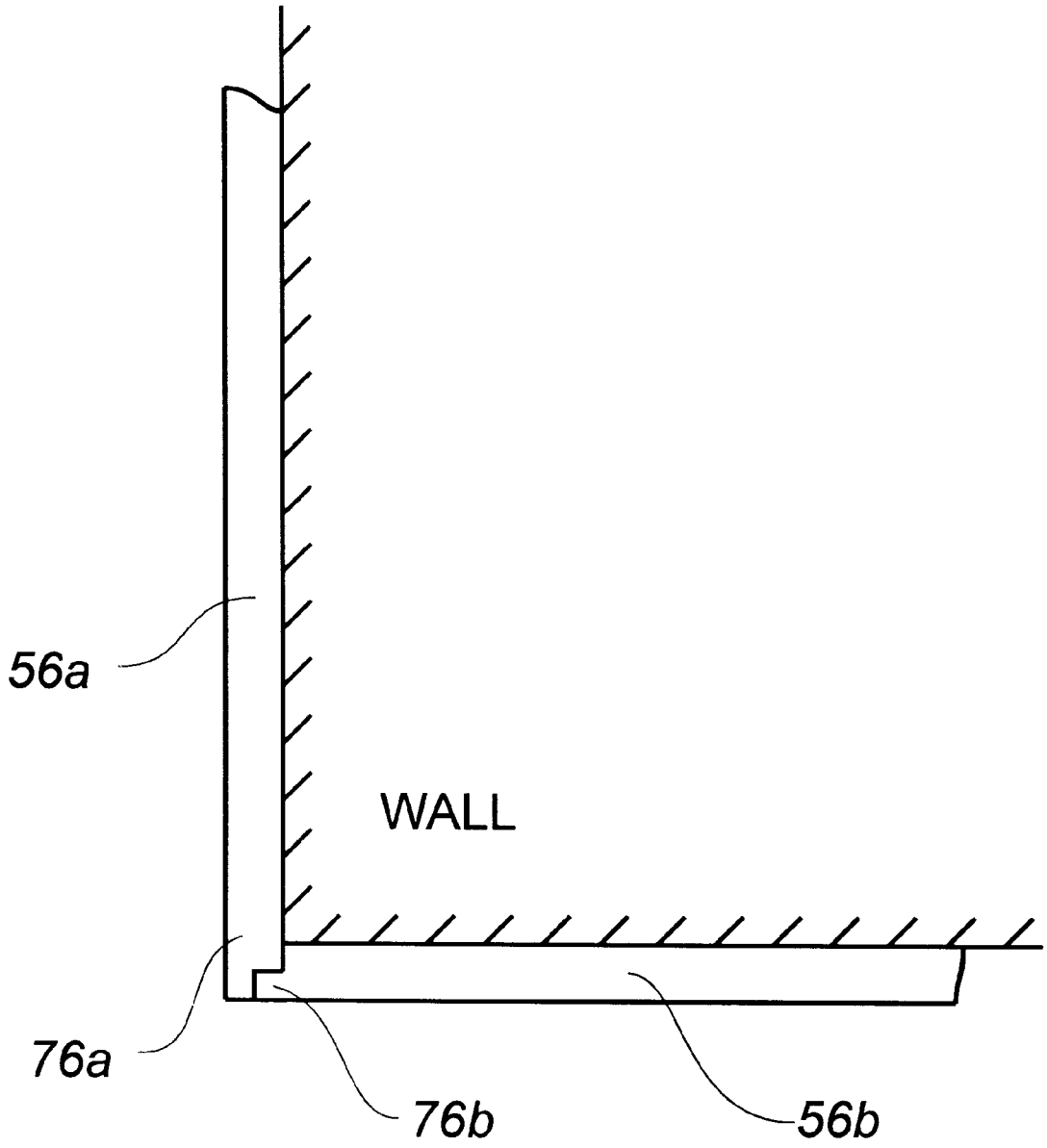
FIG. 9 is a cross-sectional view of the joint between adjacent stiles at an outside corner according to one embodiment of the present invention.

50. As shown in FIG. 9, stile 56*a* may be allowed to partially overhang the corner and stile 56*b* engages stile 56*a* such that a lip 76*a* in stile 56*a* is interlocked with a lip 76*b* in stile 56*b*. Optionally, a small amount of construction glue may be used to adhere stiles 56*a* and 56*b* to the wall. To get an appropriate fit between stiles 56*a* and 56*b*, it may be advantageous to reduce the width of stile 56*a* and/or 56*b* by removing a lengthwise portion of these components.

Figure 10:
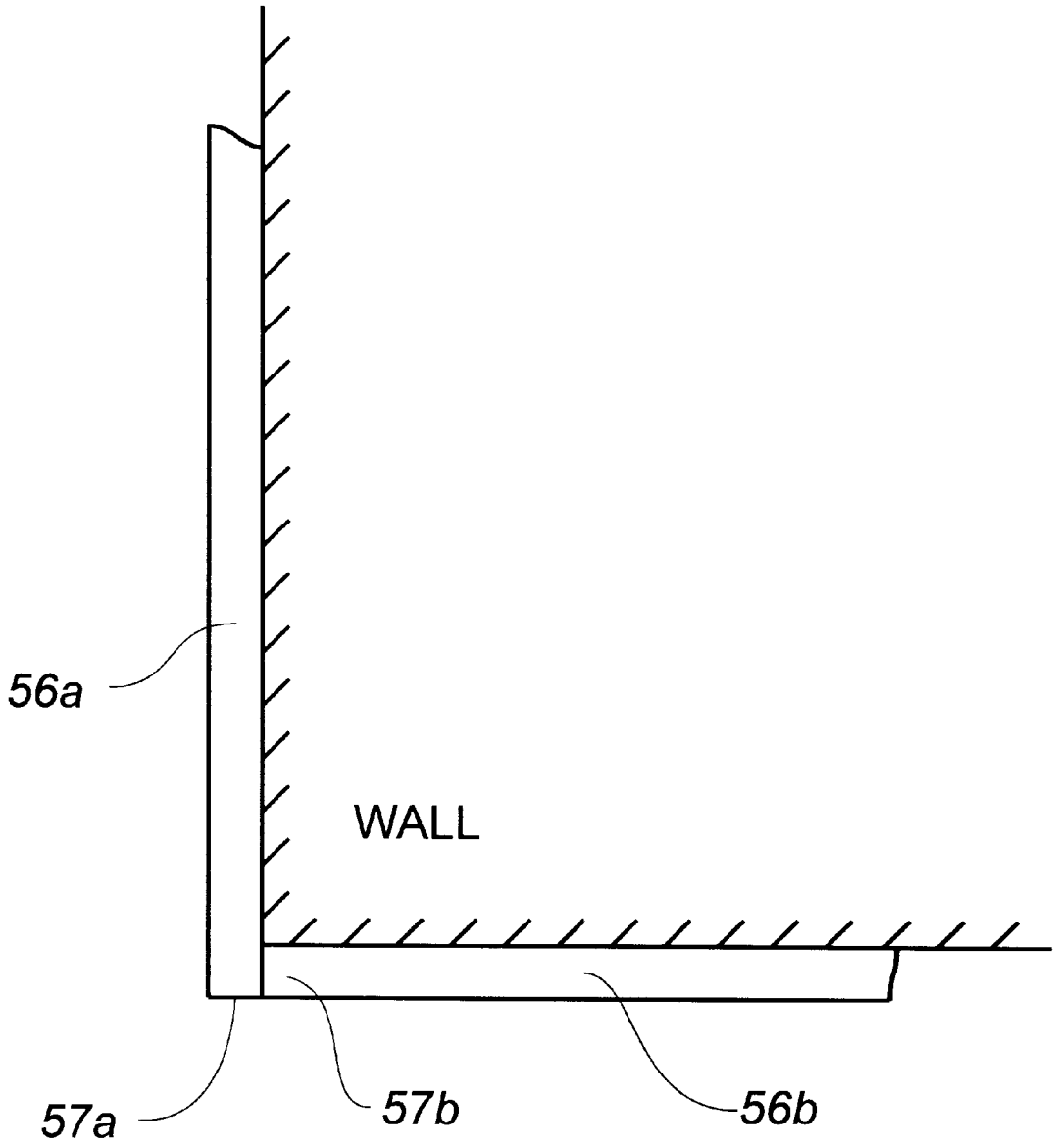
FIG. 10 is a cross-sectional view of the joint between adjacent stiles at an outside corner according to another embodiment of the present invention.

FIG. 10 shows an alternate approach to fitting stiles 56*a* and 56*b* at an outside corner of a wall. The lip is removed from stile 56*a*, and flat end 57*a* extends beyond the wall. The lip is also removed from stile 56*b* and flat end 57*b* is disposed against flat end 57*a* to form the joint between stile 56*a* and stile 56*b*.

The particular dimensions of the components of system 50 may vary depending upon the intended use. It is envisioned that certain standard dimensions may be used for each component. For example, panels 58 may have a height of about 23 inches, a maximum thickness of about ½ inch, and, when incorporated into system 50, exposed widths of about 6 inches, about 9 inches or about 12 inches. Stiles 56 may have a maximum width of about ½ inches, a height of about 23 inches and, when incorporated into system 50, exposed widths of about 3 or about 10 inches. Upper rail 52 and lower rail 54 both have a height of about 4 inches or about 8 inches and a thickness of about ⅝ inches. Cap 62 and base shoe 64 both have a height of about 1¼ inches. Cap 62 is about 1 ½ inches, and base shoe 64 is about ⅝ inches thick.

Typically, system 50 is assembled to partially or entirely cover a wall surface. It is to be understood, however, that system 50 may be applied to any solid surface, whether it be substantially vertical or horizontal. For example, system 50 can be used to partially or entirely cover the vertical support surface of a bar. Alternatively, system 50 can be used to partially or entirely cover the vertical support surface of a lectern or a podium. It is envisioned that system 50 can be used to cover the lower portion of a wall surface (e.g., the lower third of the wall surface), commonly referred to as wainscoting.

Having thus described certain embodiments of the present invention, various alterations, modifications and improvements will be apparent to those skilled in the art. Such alternation, modifications and improvements are intended as part of this disclosure and are intended to be within the spirit and scope of the present invention. For example, the components of system 50 need not be made from a wood veneer coated core material. Instead, they may be made from solid wood or other appropriate solid materials. Each component of system 50, however, preferably is made from the same wood veneer coated core material. Furthermore, in some embodiments, panels 58 may be flat or indented. Moreover, some components of system 50 may not be directly attached to a wall surface. Rather, in certain embodiments, these components may be indirectly attached to the wall surface by directly attaching the components to an object, such as a board, which is directly attached to the wall surface. Accordingly, the foregoing description is by way of example only and is not intended as limiting. The present invention is limited only as defined by the following claims and the equivalents thereto.

What is claimed is:

1. A wood panel system comprising:

an upper rail having an upper rail L-shaped groove, the upper rail being in rigid communication with a wall;

a lower rail having a lower rail L-shaped groove, the lower rail being in rigid communication with the wall; and a first stile having a first stile upper L-shaped groove and a first stile lower L-shaped groove formed respectively in part by an upper tongue and a lower tongue, wherein the upper tongue and the lower tongue respectively mate with the upper rail L-shaped groove and lower rail L-shaped groove such that the upper tongue is sandwiched directly between a surface of the upper rail L-shaped groove and the wall, and the lower tongue is sandwiched directly between a surface of the lower rail L-shaped groove and the wall.

2. The wood panel system according to claim 1, wherein a groove in at least one of the upper rail, the lower rail and the first stile is noncoped.

3. The word panel system according to claim 1, wherein the first stile floats with respect to the upper and lower rails.

4. The wood panel system according to claim 1, further comprising a panel having an upper tongue and a lower tongue, the upper tongue of the panel being directly sandwiched between the surface of the upper rail L-shaped groove and the wall, and the lower tongue of the panel being directly sandwiched between the surface of the lower rail L-shaped groove and the wall.

5. The wood panel system according to claim 4, wherein the first stile has a first stile side L-shaped groove and the panel has a side tongue, wherein the side tongue is sandwiched directly between a surface of the first stile side L-shaped groove and the wall.

6. The wood panel system according to claim 4, further comprising a second stile, the second stile in contact with the upper rail and lower rail on a side of the upper rail and lower rail opposite the first stile.

7. The wood panel system according to claim 1, wherein the stile is formed of a core material surrounded by a wood veneer coating.

8. A wood panel system comprising:

a rail having an L-shaped groove, the rail being in rigid communication with a wall;

a stile having a tongue at one edge of the stile and an L-shaped groove at an adjacent edge of the stile;

a panel having a tongue at an edge of the panel; and wherein the tongue of the stile is sandwiched between the L-shaped groove of the rail and the wall and the tongue of the panel is sandwiched between the L-shaped groove of the stile and the wall.

9. A wood panel system comprising:

an upper rail having an upper L-shaped groove and an outer surface, the upper rail being in rigid communication with a wall, the outer surface of the upper rail being disposed within a first plane substantially parallel to the wall;

a lower rail having a lower L-shaped groove, the lower rail being in rigid communication with the wall; and a first stile having an upper tongue, a lower tongue and an outer surface, the upper tongue of the first stile being sandwiched directly between a surface of the upper rail L-shaped groove and the wall, the lower tongue of the first stile being sandwiched directly between a surface of the lower rail L-shaped groove and the wall, the outer surface of the first stile being disposed within a second plane substantially parallel to the wall, and the second plane being different than the first plane.

10. The wood panel system according to claim 9, wherein the lower rail has an outer surface disposed within a third plane substantially parallel to the wall, the third plane being different than the second plane.

11. The wood panel system according to claim 10, wherein the first and third planes are a same plane.

12. The wood panel system according to claim 11, wherein the first stile floats with respect to the upper and lower rails.

13. The wood panel system according to claim 9, further comprising a panel having an upper tongue and a lower tongue, the upper tongue of the panel being directly sandwiched between the surface of the upper rail L-shaped groove and the wall, the lower tongue of the panel being directly sandwiched between the surface of the lower rail L-shaped groove and the wall.

14. The wood panel system according to claim 13, wherein the first stile has a first stile side L-shaped groove and the panel has first and second side tongues, wherein the first side tongue of the panel is sandwiched directly between a surface of the first stile side L-shaped groove and the wall.

15. The wood panel system according to claim 14, further comprising a second stile having an upper tongue, a lower tongue and a second stile side L-shaped groove, and wherein the upper tongue of the second stile is sandwiched directly between the surface of the upper rail L-shaped groove and the wall, the lower tongue of the second stile is sandwiched directly between the surface of the lower rail L-shaped groove and the wall, and the second tongue of the panel is sandwiched directly between a surface of the second stile side L-shaped groove and the wall.

16. The wood panel system according to claim 9, wherein the upper rail has a lip extending over a portion of the first stile.

17. The wood panel system according to claim 9, wherein the stile is formed of a core material surrounded by a wood veneer coating.

18. A wood panel system comprising:

an upper rail having an upper L-shaped groove, the upper rail being in rigid communication with a wall;

a lower rail having a lower L-shaped groove, the lower rail being in rigid communication with the wall; and a stile having an upper tongue and a lower tongue, the upper tongue of the stile being sandwiched directly between a surface of the upper rail L-shaped groove and the wall, the lower tongue of the stile being sandwiched directly between a surface of the lower rail L-shaped groove and the wall, and wherein the stile floats with respect to the upper and lower rails.

19. The wood panel system according to claim 18, wherein the upper rail has a lip that extends over a portion of the stile.

20. A wood panel system comprising:

an upper rail having a non-coped upper L-shaped groove, the upper rail being in rigid communication with a wall;

a lower rail having a non-coped lower L-shaped groove, the lower rail being in rigid communication with the wall; and a stile having an upper non-coped groove that mates with the non-coped upper L-shaped groove of the upper rail and a lower non-coped groove that mates with the non-coped lower L-shaped groove of the lower rail so that the upper and lower non-coped grooves of the stile are sandwiched between the upper and lower L-shaped grooves of the rails, respectively, and the wall.

21. The wood panel system according to claim 20, wherein at least one of the upper rail, the lower rail, and the stile is formed of a core material surrounded by a wood veneer.

22. The wood panel system according to claim 20, wherein the wood veneer has a thickness of less than about 0.17 inches.

23. The wood panel system according to claim 20, wherein the stile floats with respect to the upper and lower rails.

24. The wood panel system according to claim 20, wherein the upper rail has an outer surface disposed in a first plane substantially parallel to the wall and the first stile has an outer surface disposed in a second plane substantially parallel to the wall, the first plane being different than the second plane.

25. A wood panel kit comprising:

an upper rail having an upper L-shaped groove;

a lower rail having a lower L-shaped groove;

a plurality of stiles having an upper tongue, a lower tongue, and side L-shaped grooves; and a plurality of panels having upper, lower, and side tongues.

26. The wood panel kit of claim 25, wherein the rails comprise a first thickness, the stiles comprise a second thickness, and the first thickness is different than the second thickness.

27. The wood panel kit of claim 25, wherein at least one of the upper rail, the lower rail, the stiles, and the panels is formed of a core material surrounded by a wood veneer.

* * * * *